US005921538A

United States Patent [19]

Schlough

[11] Patent Number: 5,921,538

[45] Date of Patent: Jul. 13, 1999

[54] APPARATUS AND METHOD FOR COMBINED GATHERING AND BINDING OF SHEET LIKE ARTICLES

[75] Inventor: James R. Schlough, Troy, Ohio

[73] Assignee: Heidelberger Druckmaschinen AG, Heidelberg, Germany

[21] Appl. No.: 08/946,516

[22] Filed: Oct. 7, 1997

[51] Int. Cl.[6] ..... B65H 39/045

[52] U.S. Cl. ..... 270/52.18; 270/52.2; 270/52.29; 270/58.08; 412/37; 412/8

[58] Field of Search ..... 270/52.14, 52.16, 270/52.17, 52.18, 52.2, 58.23, 58.29, 58.18, 58.1, 58.11, 58.16, 58.07, 58.08; 412/9, 10, 1, 8, 37, 33, 900; 271/287, 292, 294

[56] References Cited

U.S. PATENT DOCUMENTS

| | | | |
|---|---|---|---|
| 3,580,563 | 5/1971 | Bassett | 270/58.18 |
| 4,133,521 | 1/1979 | Muller | 270/52.2 |
| 4,721,296 | 1/1988 | Mowry | 270/52.2 |
| 4,904,139 | 2/1990 | Champeaux et al. | 412/9 X |
| 4,949,948 | 8/1990 | Peterson | 270/52.14 |
| 4,988,086 | 1/1991 | Schlough | 270/52.2 |
| 5,054,984 | 10/1991 | Chan et al. | 412/1 |
| 5,251,888 | 10/1993 | Eugster | 270/52.2 |

*Primary Examiner*—William E. Terrell
*Assistant Examiner*—Patrick Mackey
*Attorney, Agent, or Firm*—Tarolli, Sundheim, Covell, Tummino & Szabo

[57] ABSTRACT

A plurality of sheet material feeders (9) are arranged along a continuous path (4), and supply sheet material articles (17) to sheet material assemblers (12). A plurality of sheet material assemblers (12) are moved sequentially along said continuous path (4) and receive sheet material articles (17) at the sheet material feeders (9). The sheet material assemblers (12) have an upper section (12.1) for gathering sheet material articles (17) constituting an assemblage (46) and a lower section (12.2) for receiving the gathered sheet material assemblage (46) from said upper section (12.1). Binding operations on said assemblages are performed when the assemblage is in the lower section (12.2).

28 Claims, 5 Drawing Sheets

9
12
12.1
12.2
13
15
16
17
22
23
33
34
43
44
45
46
47
49
49.1
50
51
52

APPARATUS AND METHOD FOR COMBINED GATHERING AND BINDING OF SHEET LIKE ARTICLES

FIELD OF THE INVENTION

The present invention is an apparatus and method for combined gathering and binding of sheet like articles, in the same production line.

BACKGROUND OF THE INVENTION

U.S. Pat. No. 3,580,563 is related to a collating machine feeding into or out of racks. A horizontal framework carries a plurality of transverse, inclined, parallel, paper-supporting racks. A conveying system on the machine, including a belt, transport sheets of paper emerging from a reproduction apparatus into predetermined ones of the racks. After the desired number of sheets have been placed in the racks in the appropriate sequence, various adjustments are made to the machine, including reversal of belt movement, enabling the machine to collate the sheets of paper previously assembled in the racks. The collating mechanism includes structure enabling the operator to adapt the machine to varying paper sizes, textures and weights.

U.S. Pat. No. 5,251,888 is related to an inserting machine with pockets having adjustable stops. Each of the pockets which are arranged at regular distance apart and are movable along an endless path, is provided with two vertically adjustable stops for the printed product placed into the pocket. The stops are mounted displaceably in a pocket carrier. Within the pocket carrier there is horizontally arranged a slide which has two elongated openings of slight inclination to the horizontal. A projection on each stop is guided in the corresponding opening of the slide accordingly effects a vertical displacement of the stops. A guide member which is displaceable in the direction of the slide on a carrier fixed to the machine has a guide groove for a projection arranged on the protruding end of the slide. Upon the moving past of the pockets the projection moves through the guide groove so that the slide is brought into a corresponding horizontal position and the stops are brought into a corresponding vertical position. Upon change of the height of the printed product, therefore, only the guide member needs newly be set on the carrier in order for the printed products to lie at the correct height in all pockets.

U.S. Pat. No. 4,133,521 concerns a sheet material collating apparatus. A newspaper stuffing apparatus wherein pockets which serve for reception of newspaper jackets and inner sections are transported along an endless path past a first feeder which admits openable jackets, past at least one second feeder which admits inner sections into opened jackets in successive pockets, and thereupon past an evacuating device which removes the thus assembled newspapers from successive pockets. Each pocket is associated with a retaining blade which is held at one end of the pocket during travel past the first feeder, which is moved by a spring into the pocket and clamps one-half of the opened jacket against one wall of the pocket during travel toward and past the second feeder and which is retracted from the pocket not later than when the pocket reaches the evacuating device. Each blade is reciprocal along and is held against rotation relative to a guide shaft which is located behind the one wall of the respective pocket and can be rotated to move the blade against or away from one-half of the opened jacket in the respective pocket.

Finally, U.S. Pat. No. 4,988,086 is related to an apparatus and method for forming sheet material assemblages. An apparatus for forming sheet material assemblages includes a plurality of sheet material assemblers which travel in a continuous path and sequentially pass beneath stacks of sheet material. The stacks of sheet material are disposed in bottomless hoppers. The sheet material assemblers include belts which support the stacks of sheet material in the bottomless hoppers. The belts move with the sheet material assemblers to sequentially engage the stacks of sheet material. Upper runs of the belts move in opposite directions to the sheet material assemblers so that the upper runs of the belts are stationary relative to the stacks of material. The sheet material assemblers also include feed mechanisms and receiving locations. As a sheet material assembler passes under a stack of sheet material, sheet material is fed from the stack of sheet material by a feed mechanism to a receiving location.

SUMMARY OF THE INVENTION

It has been found that upon gathering the sections of bound products that the most common disadvantage is the difficulty in transferring and reorienting the product for binding. Given the serially arranged assembly of processing components used today to manufacture books and periodicals, there are frequent transfers of the product in the process, each of which presents the potential for jams and other negative occurrences.

Given the solutions of the prior art known heretofore and having sketched the technical problem, it is accordingly one main object of the present invention to provide gathering assemblies having the components necessary to accomplish the binding process without having to transfer the products to a different machine.

It is a further object of the invention to decrease the size and cost of the machinery involved.

It is still a further object of the invention to process the product in the perpendicular orientation to a face direction on short centers to decrease processing velocity.

According to the present invention a sheet material article gathering and binding assembly includes: a plurality of sheet material feeders arranged along a continuous path, a plurality of sheet material assemblers being moved sequentially along said continuous path receiving sheet material articles from said sheet material feeders, said sheet material assemblers having an upper section for gathering sheet material articles constituting an assemblage and a lower binding section for receiving gathered sheet material assemblages from said upper assembler section, binding operations on said assemblages being performed in the lower binding section.

The given solution according to the present invention eliminates frequent transfers of the product, each of which presents a potential for jams or malfunction. There is no more need to transfer gathered assemblages to different machines for performing binding operations. According to the present invention, the bindery line has been successfully integrated into a gathering line, thereby significantly reducing the risk of exposing gathered assemblages to jams. Furthermore, since the sheet material articles are oriented perpendicularly towards the stack location, the spine of the respective assemblages is located in a position favoring binding operations.

According to the present invention both, the upper and lower binding sections have a sheet material transfer region. An upper assembler section's bottom is laterally offset from a lower binding section's entry region. The respective lower binding section is oriented perpendicular towards the location of the stack of sheet material articles. This orientation significantly facilitates the binding operations on a collated assemblage, which has been transferred to the lower binding section. For a reliable transfer of collated assemblages towards the lower binding section, the upper assembler section comprises a moveable pocket wall member. The moveable wall member is connected to a linkage, which is either cam actuated or pneumatically actuated and is pivotable into a release position connecting the upper assembler section's bottom to the entry region of the lower binding section for transferring the collated assemblages towards the lower binding section. The lower binding section is provided with a release member, which is pivotably mounted on an axis and enables the spine of the received assemblages to be exposed for preparation for binding operations. Due to the substantially perpendicular orientation of the collated assemblages, the bottom edge of which is now exposed, binding operations now can be performed on them, while upon completing a further circuit along said sheet material article feeders, the respective upper assembler section of the sheet material assembler collates a new sheet material assemblage, while the assemblage previously collated is bound in the respective lower binding section.

The method for gathering and binding sheet material articles in a sheet material assembler according to the present invention comprises the steps of: gathering sheet material articles in an upper section of a sheet material assembler, transferring an assemblage of sheet material articles to a lower section of a sheet material assembler, clamping the assemblage, removing material from the bottom edge of the individual sheets of said assemblage, applying adhesive to the surface of the bottom edges, applying a cover for encasing the assemblage to the adhesive, and delivering the bound products to a number of different trimming and/or mailing lines.

For transferring the sheet material articles gathered in the upper section of the sheet material assembler, they are laterally shifted by pocket walls. Upon lateral shift of the gathered sheet material articles collated in said upper assembler section, the collated assemblage is released towards the lower binding section. The respective sheet material assemblages being gathered in the upper assembler section and bound in said lower binding section are substantially held in a perpendicular orientation facilitating the bindery operations. The sheet material assemblages received from the upper assembler section are clamped in the lower binding section for facilitating the removal of material from the bottom edge (spine) of the assemblage. This removal of material facilitates the application of an adhesive to each individual sheet of the assemblage. After application of an adhesive to the spine comprising the exposed bottom edges of the collated assemblage, a cover is applied to the assemblage.

During a first circuit along a continuous path, the sheet material assemblers including upper assembler sections and lower binding sections gather all the sheet material from said feeding stations in the respective upper assembler sections. After the first circuit along the feeding stations is completed, said collated assemblages are transferred to the lower binding section of the respective sheet material assemblers. The transfer of the collated assemblages from the respective upper section to the respective lower section of the sheet material assemblers may occur during a number of cycles of the sheet material assemblers along the continuous path. Upon a further circuit of the sheet material assemblers along the continuous path a new sheet material assemblage is gathered in the upper assembler section, while the assemblage gathered upon the previous circuit is being bound in the lower binding section.

BRIEF DESCRIPTION OF THE DRAWINGS

The novel features which are considered as characteristic of the invention are set forth in particular in the appended claims. The invention itself however, both as to its construction and its method of operation together with additional objects and advantages thereof, will be best understood from the following description of a specific embodiment when read in connection with the accompanying drawings, in which:

DESCRIPTION OF PREFERRED EMBODIMENT

Figure 1:
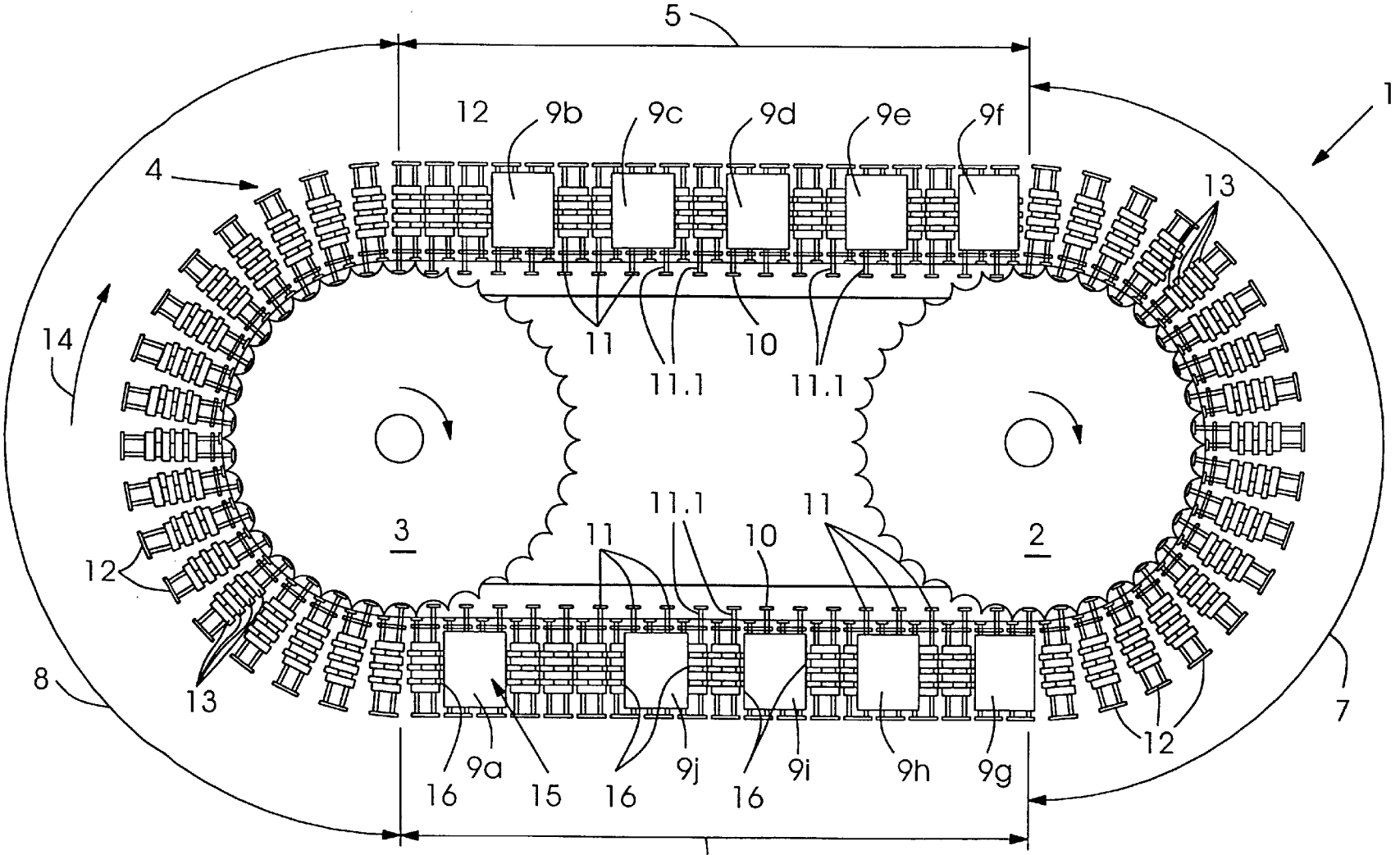
FIG. 1 is a schematic plan view of an apparatus for forming sheet material assemblages and illustrating the relationship between stationary bottomless hoppers for receiving stacks of sheet material and movable sheet material assemblers.

FIG. 1 is a schematic plan view of an apparatus for forming sheet material assemblages illustrating the relationship between stationary bottomless hoppers for receiving stacks of sheet material and movable sheet material assemblers.

A combined gathering and binding assembly 1 includes an endless chain of sheet material assemblers 12 arranged one beside the other, the chain being rotated about two drive wheels 2, 3 respectively. Above the endless chain, which is moved on a stationary base 10, a plurality of bottomless sheet material feeders 9 is arranged. The plurality of sheet material feeders 9*a*–9*j* are spaced apart from each other.

It should be noted that the term circuit means that one defined sheet material assembler 12 has completed one entire tour along all of the various sheet material feeders 9 and has returned to its original position. A cycle in contrast is defined as the part of the continuous path 4 between two adjacent feeding stations, 9*b* and 9*c* to give an example.

The sheet material assemblers 12 are arranged along a continuous path 4, said path being defined by two linear sections 5, 6, respectively, as well as a first non-linear section 7 and a second non-linear section 8. Upon conveyance along said continuous path 4 in a direction 14 as indicated, said sheet material assemblers 12 pass, in the linear section 5, bottomless feeders 9*b*–9*f* and after having passed said second non-linear section 7 said sheet material assemblers 12 pass said bottomless feeders 9*g*–9*j* and 9*a*.

The sheet material assemblers 12 may receive, to give an example, a sheet material article (signature) 17 from said bottomless feeder 9*a* and thereafter may receive a sheet material article 17 from each of the feeders 9 during a circuit of an assembler 12. After completion of a circuit past said plurality of feeders 9, an assemblage of sheet material articles 17 is collated in the sheet material assembler 12.

Each sheet material assembler 12 includes a drive roller 11 mounted on a drive shaft 11.1 driving a belt 13. The respective upper runs 20 of said belts 13 form the bottom of said bottomless feeders 9 as described in U.S. Pat. No. 4,988,086, which is hereby incorporated by reference. Said plurality of bottomless feeders 9 comprises a rectangular side wall arrangement 16, within which stacks 15 of sheet material 17 are located to be fed to the moving sheet material assemblers 12.

Figure 2:
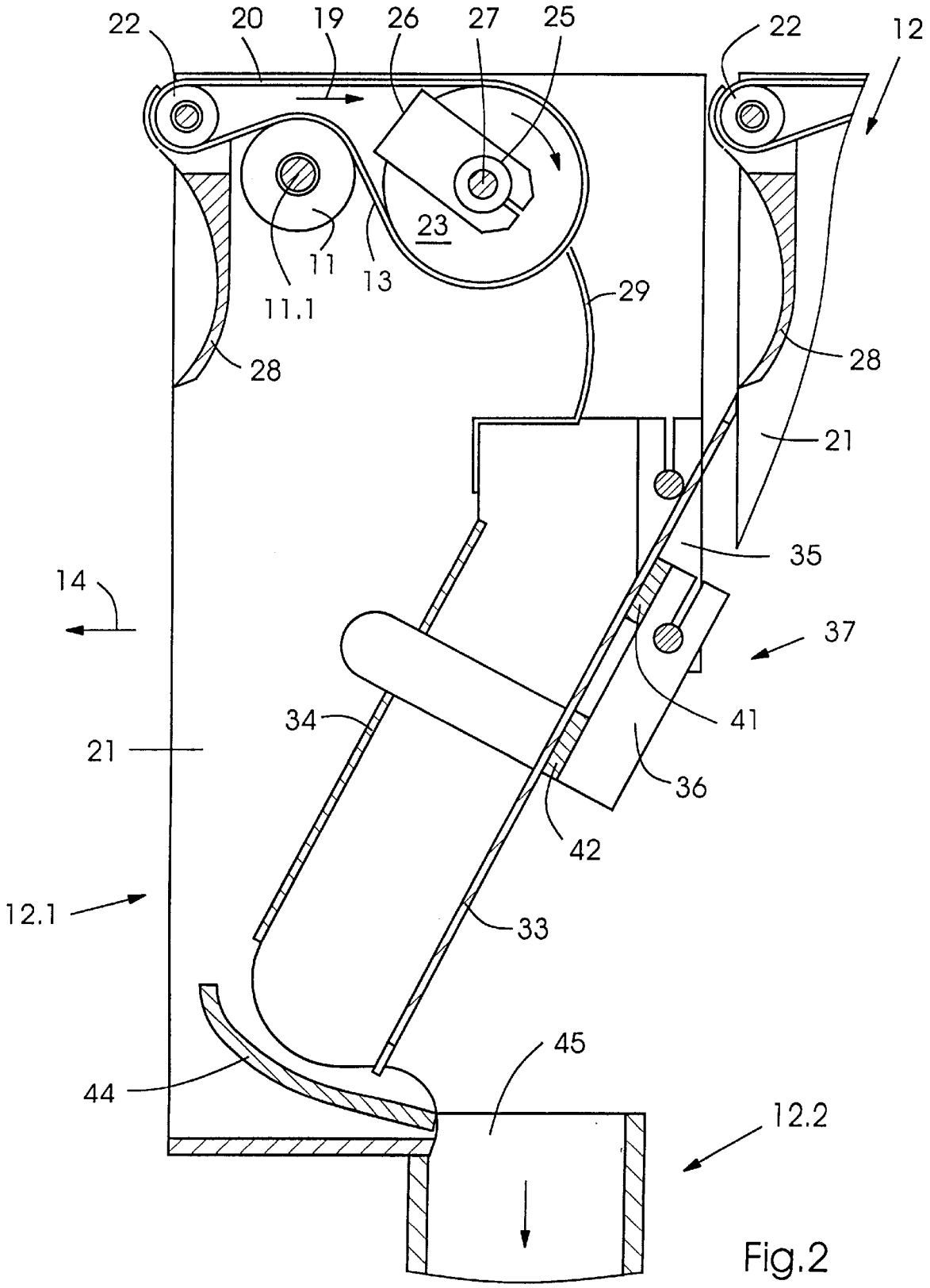
FIG. 2 is a sectional view of one sheet material assembler having an upper and a lower section, the upper section being in a closed condition.

FIG. 2 is a sectional view of one sheet material assembler having an upper and a lower section, the upper section being in a closed condition.

Each sheet material assembler 12 has an upper assembler section 12.1 and a lower binding section 12.2. The upper assembler section 12.1 includes a pair of side frames 21, between which said belts 13 are mounted. Said belts 13 have respective upper runs 20 which form the respective temporary bottoms of said bottomless feeders 9, when receiving a sheet material article 17 from a stack 15 located between the side wall arrangement 16. The belts 13 rotate about an idler roller 22 and a further idler roller 23 having different diameters. Said belts 13 are driven by said drive rollers 11 (see FIG. 1) being mounted upon a drive shaft 11.1. Thus, upon movement of the sheet material assembler 12 in travel direction 14, said belts 13 are rotated in an opposite direction as indicated by the arrow 19 in FIG. 2. In this way said upper belt runs 20 form a temporary bottom of said bottomless feeders 9. Upon activation of a gripper head 26 (schematically shown) mounted on a shaft 25, a sheet material article 17 is seized, due to vacuum in the gripper head 26 provided by a vacuum line 27, and conveyed between a right upper pocket wall 33 and a left upper pocket wall 34 arranged between said side frames 21 of said sheet material assembler 12.

In the position shown in FIG. 2, the right upper pocket wall 33 is in its closed condition. Upon receipt of a sheet material article 17 in the space between the left upper pocket wall 34 and the right upper pocket wall 33 a rearward edge thereof may be held by a suction element (not shown) connectable to a known vacuum source. As can be further derived from FIGS. 2 and 3, said right upper pocket wall 33 is linked to a linkage 37 comprising a first actuating element 35 and a second actuating element 36 to move said right upper pocket wall 33 between a respective opening and closing position. The actuating element 36 is connected to the pocket wall 33 by members 41 and 42.

The respective upper section 12.1 further includes a guide plate 28, which in cooperation with an adjacent sheet material assembler 12 forms a funnel-shaped entry section into the upper assembler section 12.1. Further, a stripper blade 29 is arranged below said belt 13 to gently remove a sheet material article 17 form said gripper head 26, after the vacuum in said vacuum line 27 has been switched off.

Figures 4A, 4B, 4C, 4D, 4E:
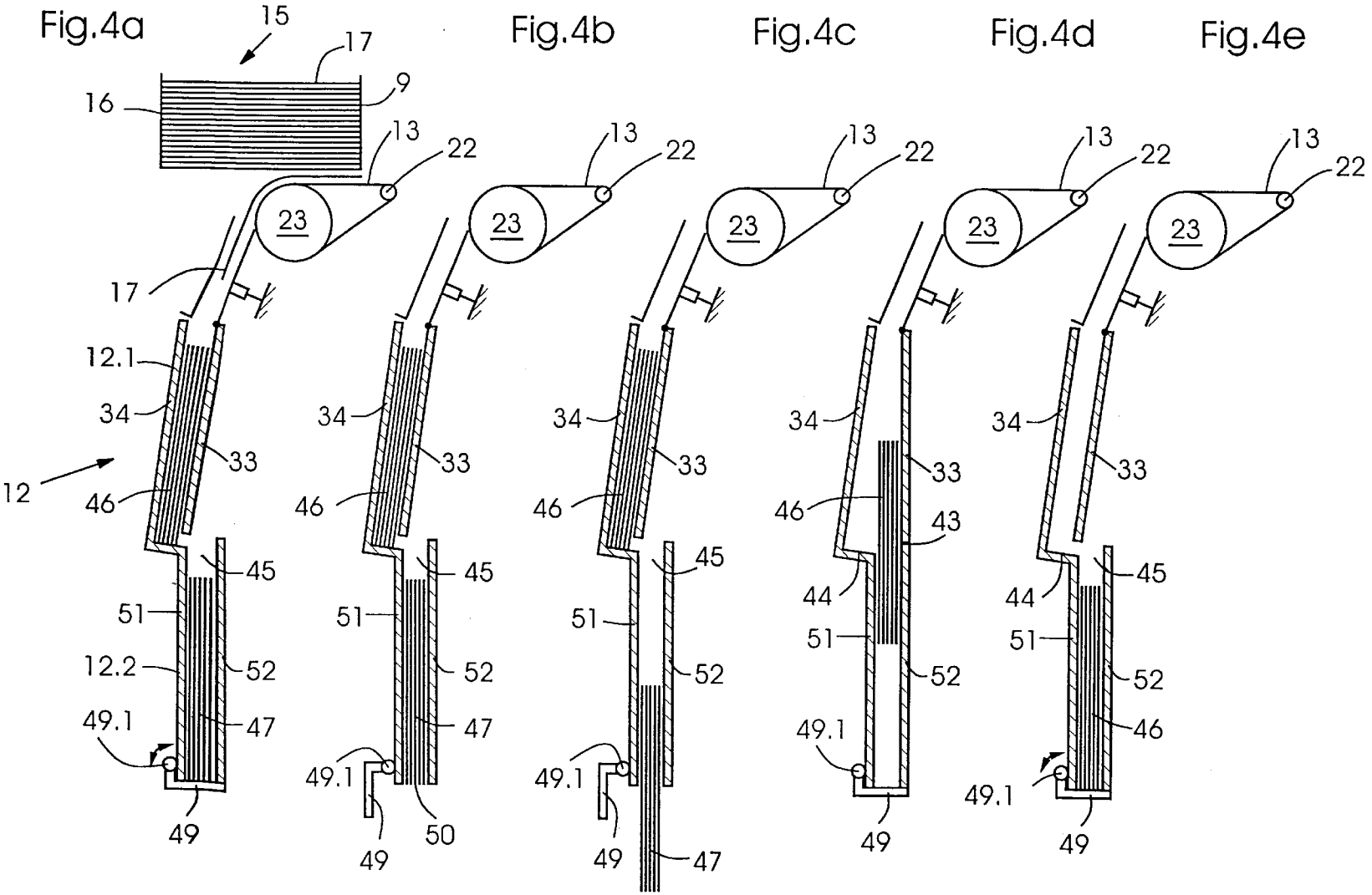
FIG. 4 is a schematic view of various sheet material assemblers of a modified construction, each having an upper and a lower section, and showing a transfer of a collated assemblage from an upper to a respective lower section.

The sheet material assembler 12 includes a respective lower binding section 12.2 arranged laterally offset relative to the upper assembler section 12.1. Said upper assembler section 12.1 is oriented in an inclined position, whereas the lower binding section 12.2 is oriented perpendicular to the belt travel direction indicated by arrow 19. The right upper pocket wall 33 is moved either via a cam arrangement or by pneumatic means to a release position 43 (FIG. 4*d*). Thus, said collated assemblage which is gathered between said left upper pocket wall 34 and said right upper pocket wall 33 upon a circuit of the sheet material assemblers 12 past the feeders 9 can be transferred to a lower binding section's entry region 45 (FIG. 4*a*) to be moved into said lower binding section 12.2. The respective perpendicular orientation of said lower binding section 12.2 favors the binding operation to be performed on the collated assemblages in the lower binding section 12.2.

Figure 3:
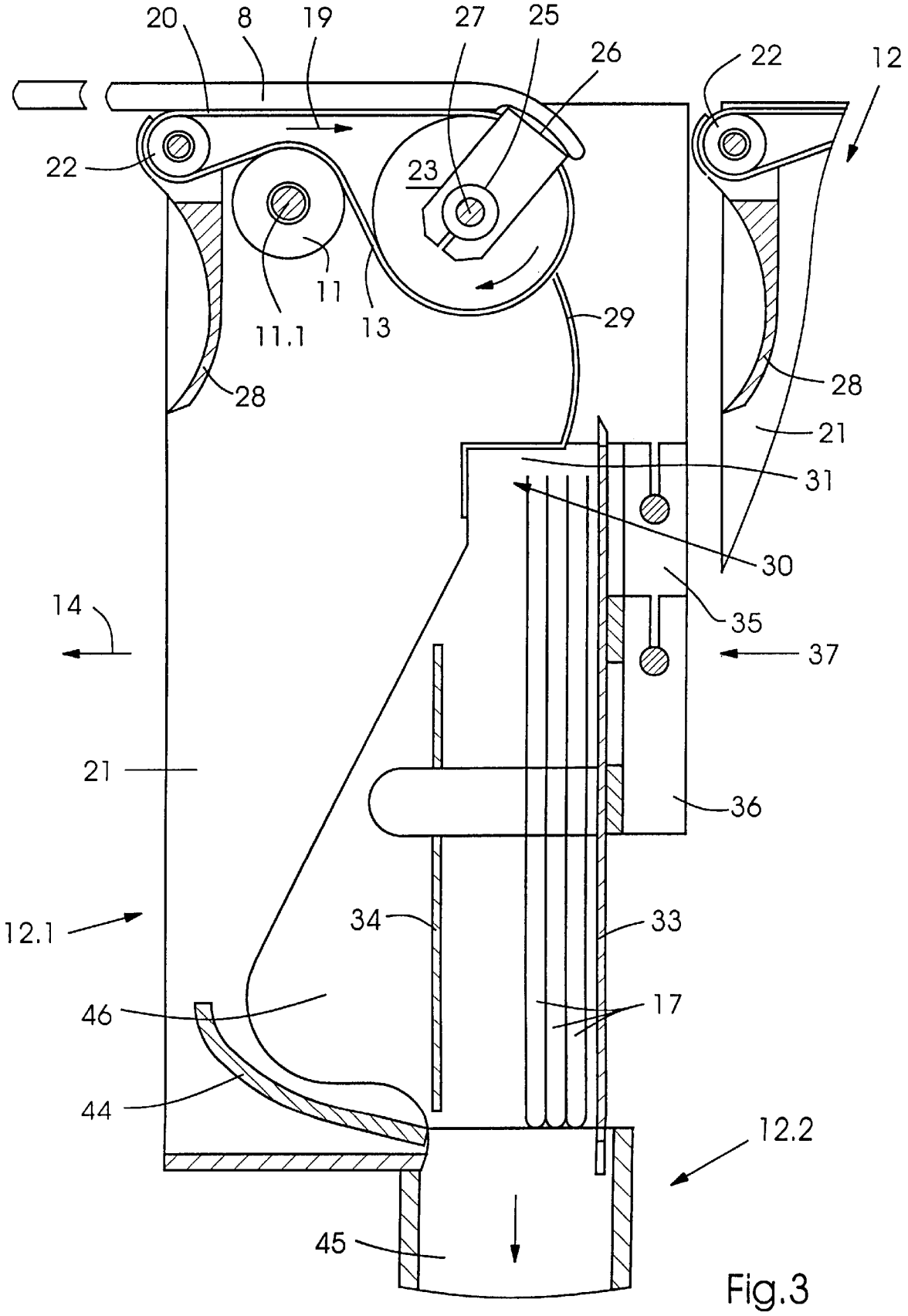
FIG. 3 is a sectional view of one sheet material assembler having an upper and a lower section, the upper section being in a transferring condition.

FIG. 3 is a sectional view of one sheet material assembler having an upper assembler section 12.1 and a lower binding section 12.2. The upper assembler section 12.1 is in a transferring position for transferring a collated assemblage to the lower binding section 12.2.

Upon completion of a full circuit, a sheet material assemblage 46 (FIG. 4*a*) is gathered between a left upper pocket wall 34 and a right upper pocket wall 33. In the stage given in FIG. 3, a sheet material assemblage is in position to leave the upper assembler section pocket 12.1 and move into the entry 45 of a lower binding section 12.2.

As shown in FIG. 3, the pocket walls 33, 34 are connected to said linkage 37 of actuating elements 35, 36. Thus, both pocket walls 33, 34 are moved into the releasing position. Simultaneously, the various sheet material articles 17 form a complete assemblage 46, which moves due to gravity into the respective binding sections 12.2 of the sheet material assembler 12.

After the assemblage 46 gathered during the previous circuit of the gathering and bindery line has been transferred into the respective lower binding section 12.2 in a further circuit a further assemblage is gathered between the left upper pocket wall 34 and the right upper pocket wall 33.

FIG. 4 is a schematic view of a sheet material assembler in various stages, the assembler having an upper assembler section and a lower binding section and illustrates a transfer of a first gathered assemblage from an upper assembler to a lower binding section.

The belt drive components, i.e., belt 13, idler rollers 22, 23 are schematically shown in FIG. 4.

The different stages, which one defined sheet assembler 12 adopts during a circuit are shown in FIG. 4.

The stack 15 of sheet material articles 17 is surrounded by a side wall arrangement 16 in the feeder 9. In the stage represented in FIG. 4*a,* a sheet material article 17 is fed from a bottomless feeder 9 to a gathered assemblage 46. In FIG. 4*a,* the sheet material article 17 is fed to a gathered assemblage 46 being held between said left upper pocket wall 34 and said right upper pocket wall 33 to complete the assemblage 46. In said lower binding section 12.2, an assemblage 47 is being held by a release member 49, which is pivotably mounted about an axis 49.1. The assemblage 47 was gathered during a previous circuit of the sheet material assembler 12 past said bottomless feeders 9.

Figure 5:
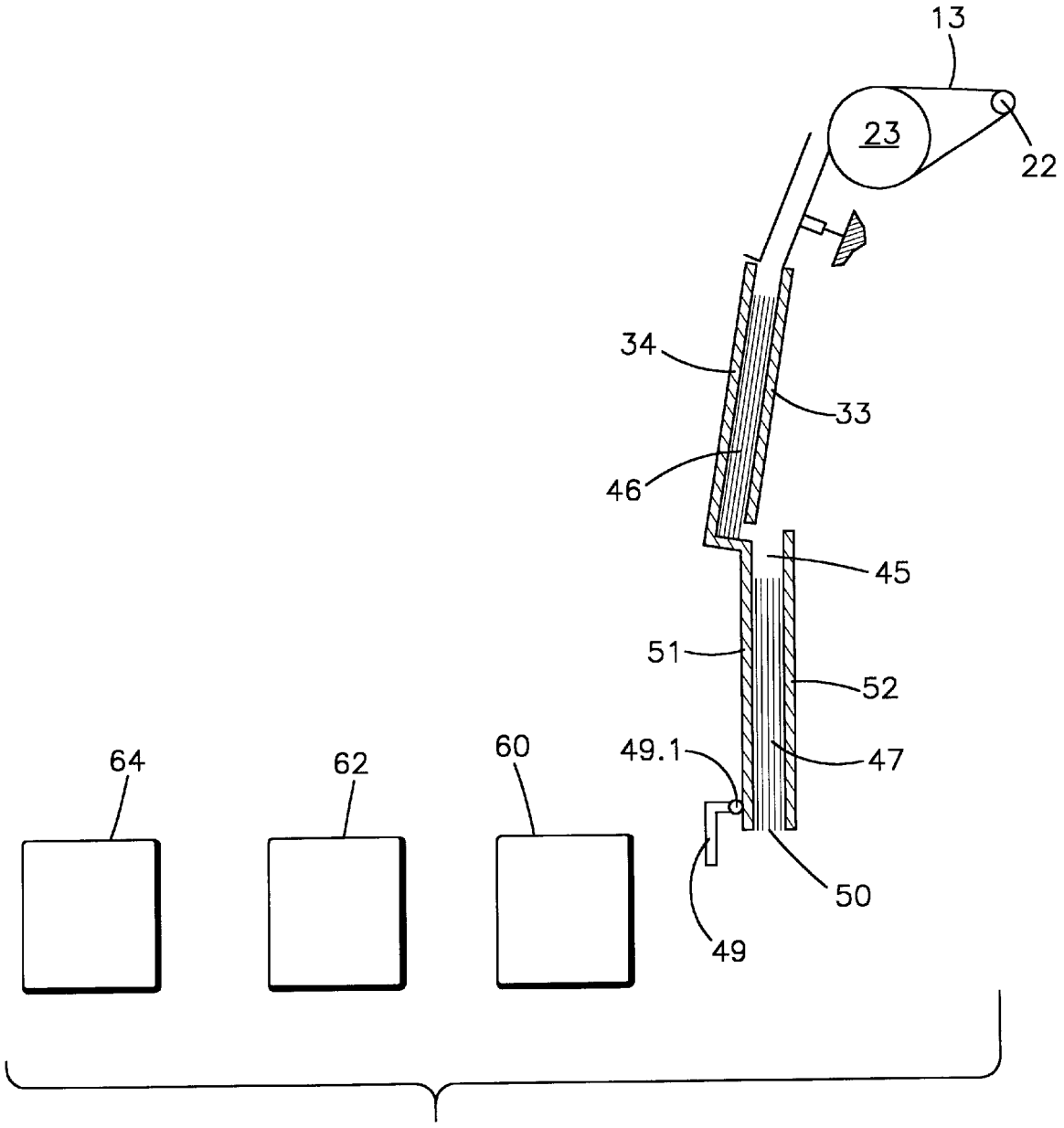
FIG. 5 is a schematic view illustrating an apparatus for roughening, applying adhesive, and applying a cover to sheet material articles.

In FIG. 4*b,* the same sheet material assembler 12 has moved along the continuous path 4, the assemblage 47 is oriented in a perpendicular orientation and is now exposed to binder treatment. Thus, the spine 50 of the assemblage 47 is exposed by swinging away said release member 49. Now removal of material from the spine 50 to prepare the spine 50 of assemblage 47 occurs prior the application of an adhesive to the spine 50, while the assemblage 46 is being held in the upper assembly section 12.1 and sheet material may be being fed to the assemblage 46. During removal of material from the spine 50 of the assemblage 47, the assemblage 47 is clamped between side walls 51, 52. The material is removed from the spine by a suitable tool as is known, such as a notcher or roughener 60 (FIG. 5). The side wall 52 is movable towards the side wall 51 to clamp the assemblage 47. After the adhesive has been applied to said spine 50 by an applicator 62, it is contemplated that a cover would be applied to the assemblage 47 and secured thereto by the adhesive on the spine 50, at a cover applicator 64.

Upon removal of the assemblage 47 from the lower binding section 12.2, the assemblage 46 in the upper assembler section 12.1 is held in place by the right upper pocket wall 33 as shown in FIG. 4*c*.

The assemblage 47 is removed from the lower binding section 12.2 by moving the wall 52 out of clamping position. This allows the assemblage with the cover secured thereto to drop from the binding section 12.2. After this occurs, the cover panels (front and back) may be folded against the assemblage if desired or the cover may be previously so folded. The assemblage 47 is now in condition for batching the assemblage 47 in mail sequence with other assemblages. These batches may be delivered to different trimming and mailing lines. In case no additional trimming is required, the assemblage 47 can be directly delivered to a suitable mailing line.

After the stage shown in FIG. 4*c,* the release member 49 is closed as shown in FIG. 4*d*. Thus, a closed pocket is formed between the respective side walls 51, 52 and the closed release member 49. Then, the right upper pocket wall 33 is moved into its release position (see FIGS. 3 and 4*d*), which releases the gathered assemblage 46 previously held by the right upper pocket wall 33 and the upper assembler section bottom 44. The gathered assembly 46 then drops by gravity into the lower section 12.2.

After the right upper pocket wall 33 has swung back into its original position as shown in FIG. 4*e,* a new assemblage can be gathered in the upper assembler section 12.1 during a subsequent circuit of the sheet material assembler 12 along the continuous path 4. In the stage shown in FIG. 4*e,* while gathering new sheet material articles 17 in the upper assembler section 12.1, binding operations can be performed upon the bottom edge 50 of the assemblage 46 after the release member 49 is moved away and the spine 50 of the perpendicular oriented assemblage is exposed. For clamping the assemblage 46, the wall 52 can be moved relative to the side wall 51.

As can be seen, the present invention eliminates a transfer of the assemblages 46, 47 to a different machine. A transfer occurs only between an upper and a lower section of a sheet material assembler 12, and the transfer can be achieved in a controlled manner avoiding potential jams. The transfer could occur over an extended number of cycles enabling the transfer to be slow and controlled. A new assemblage can be gathered in assembler section 12.1 while binding operations are performed on the assemblage in assembler section 12.2.

Also, it should be clear that, in FIG. 4, the wall 34 of the upper assembler section 12.1 does not move with the wall 33 as in FIGS. 2 and 3. In such a case, the wall 33 may have some means partially encircling the assemblage in the upper assembler section 12.1 so that when the wall 33 moves to transfer an assemblage to the lower binding section 12.2, the wall 33 pulls the collated assemblage with the wall 33. Further, in FIG. 4, the idler rollers 22, 23 and belts 13 are shown in an opposite orientation than as shown in FIG. 2. The showing in FIG. 4 is merely schematic.

Also, in FIG. 4*b,* the walls 51, 52 are shown as terminating at the bottom edge (spine 50) of the assemblage 47. The walls most preferably would terminate short of the spine 50 to thus allow a portion of the assemblage 47 to project below the walls 51, 52. This would make it easier to work on the exposed spine 50 with roughening or notching mechanisms and make it easier to apply adhesive and a cover to the spine 50.

From the above description of the invention, those skilled in the art will perceive improvements, changes and modifications. Such improvements, changes and modifications within the skill the of the art are intended to be covered by the appended claims.

Having described the invention, the following is claimed:

1. A sheet material gathering and binding assembly including:

a plurality of sheet material feeders arranged along a continuous path; and a plurality of sheet material assemblers sequentially movable along said continuous path to receive sheet material articles from said sheet material feeders;

each of said sheet material assemblers having a first section for receiving the sheet material articles to form a sheet material assemblage and a second binding section for receiving the sheet material assemblage from said first section, binding operations being performed on the sheet material assemblage in the second binding section.

2. A sheet material gathering and binding assembly according to claim 1, wherein said first section and said second section of each of said sheet material assemblers includes a transfer region.

3. A sheet material gathering and binding assembly according to claim 2, wherein said first section of each sheet material assembler has a bottom which is laterally offset from an entry region to said second binding section.

4. A sheet material gathering and binding assembly according to claim 1, wherein said second binding section of each sheet material assembler is oriented perpendicular to a stack of said sheet material.

5. A sheet material gathering and binding assembly according to claim 1, wherein said first section of each sheet material assembler has pocket walls which are pivotably mounted and pivotal by a linkage.

6. A sheet material gathering and binding assembly according to claim 5, wherein said pocket walls are moved into a releasing position above an entry area of said second binding section of said sheet material assembler by said linkage.

7. A sheet material gathering and binding assembly according to claim 1, wherein said second section of each sheet material assembler includes a pivotable release member which is pivotal to expose the bottom edge of a sheet material assemblage in said binding section.

8. A sheet material gathering and binding assembly according to claim 7, wherein said release member is pivotable about an axis.

9. A method for gathering and binding sheet material articles in a sheet material assembler comprising the steps of:

gathering the sheet material articles in a first section of the sheet material assembler while moving the first section of the sheet material assembler along a continuous path;

transferring the sheet material articles to a second binding section of the sheet material assembler while moving the second binding section of the sheet material assembler along the continuous path with the first section of the sheet material assembler;

clamping the sheet material articles in said second binding section while moving the second binding section of the sheet material assembler along the continuous path with the first section of the sheet material assembler;

removing material from bottom portions of the sheet material articles in said second binding section;

applying adhesive to the bottom portions of the sheet material articles in said second binding section; and applying a cover to the adhesive on the bottom portions of the sheet material articles in said second binding section.

10. A method according to claim 9 wherein said step of transferring sheet material articles to a second binding section includes moving a wall portion of the first section of the sheet material assembler relative to the second binding section of the sheet material assembler to move the sheet material articles sideward.

11. A method according to claim 10 wherein said sheet material articles are released for movement towards said second binding section upon sideward movement of the sheet material articles.

12. A method according to claim 9 wherein sheet material articles are gathered in the first section of the sheet material assembler and are bound in said second binding section with major side surfaces of the sheet material articles in an upright orientation.

13. A method according to claim 9 wherein sheet material articles received from the first section of the sheet material assembler are clamped in the second binding section of the sheet material assembler during performance of said steps of removing material from bottom portions of the sheet material articles and applying adhesive to the bottom portions of the sheet material articles.

14. A method according to claim 9 wherein said step of removing material from bottom portions of the sheet material articles includes exposing each individual sheet.

15. A method according to claim 14 wherein said step of applying adhesive to the bottom portions of the sheet material articles includes applying adhesive to each individual sheet.

16. A method according to claim 9 wherein said sheet material assemblers gather the sheet material articles in the first section of the sheet material assembler in an upright orientation.

17. A method according to claim 16 wherein the sheet material articles are transferred to the second binding section with the sheet material articles in an upright orientation.

18. A method according to claim 17 wherein said transfer sheet material articles to the second binding section occurs during a number of cycles of the sheet material assembler along the continuous path.

19. A method according to claim 9 wherein sheet material articles gathered in the first section of the sheet material assembler on one circuit of the sheet material assemblers are bound on a next succeeding circuit of the sheet material assemblers.

20. A method of gathering and binding sheet material articles with an apparatus which includes a plurality of sheet material assemblers each of which has a first section and a second section, said method comprises providing a first group of sheet material articles in the second section of one of the sheet material assemblers of the plurality or sheet material assemblers, moving the plurality of sheet material assemblers along a continuous path which extends past a plurality of stacks of sheet material articles, feeding sheet material articles from the stacks of sheet material into the first section of said one sheet material assembler of the plurality of sheet material assemblers to form a second group of sheet material articles while moving the plurality of sheet material assemblers along the continuous path which extends past the plurality of stacks of sheet material articles with the first group of sheet material articles in the second section of said one sheet material assembler, and performing at least a portion of a binding operation on the first group of sheet material articles in the second section of said one sheet material assembler of the plurality of sheet material assemblers while moving the plurality of sheet material assemblers along the continuous path which extends past the plurality of stacks of sheet material articles.

21. A method as set forth in claim 20 further including the steps of moving the first group of sheet material articles out of the second section of said one sheet material assembler of the plurality of sheet material assemblers after at least partially performing a binding operation on the first group of sheet material articles, and moving the second group of sheet material articles from the first section of said one sheet material assembler of the plurality of sheet material assemblers into the second section of said one sheet material assembler of the plurality of sheet material assemblers while moving the plurality of sheet material assemblers along the continuous path which extends past the plurality of stacks of sheet material articles.

22. A method as set forth in claim 21 wherein said step of moving the second group of sheet material articles from the first section of said one sheet material assembler of the plurality of sheet material assemblers into the second section of said one sheet material assembler of the plurality of sheet material assemblers includes moving the second group of sheet material articles downward from the first section of said one sheet material assembler into the second section of said one sheet material assembler.

23. A method as set forth in claim 20 wherein said step of providing a first group of sheet material articles in the second section of said one sheet material assembler of the plurality of sheet material assemblers includes feeding sheet material articles from the stacks of sheet material articles into the first section of said one sheet material assembler while moving the plurality of sheet material assemblers along the continuous path which extends past the plurality of stacks of sheet material articles to form the first group of sheet material articles in the first section of said one sheet material assembler of the plurality of sheet material assemblers, and, thereafter, moving the first group of sheet material articles from the first section of said one sheet material assembler to the second section of said one sheet material assembler.

24. A method as set forth in claim 20 wherein said step of feeding sheet material articles from the stacks of sheet material articles into the first section of said one sheet material assembler of the plurality of sheet material assemblers includes positioning sheet material articles in the first section of said one sheet material assembler with major side surfaces of the sheet material articles extending transverse to a direction of movement of the plurality of sheet material assemblers along the continuous path, said method further includes moving the second group of sheet material articles from the first section of said one sheet material assembler into the second section of said one sheet material assembler while moving the plurality of sheet material assemblers along the continuous path which extends past the plurality of stacks of sheet material articles, said step of moving the second group of sheet material articles from the first section of said one sheet material assembler into the second section of said one sheet material assembler includes moving second group of sheet material articles with major side surfaces of sheet material articles in the second group of sheet material articles extending transverse to the direction of movement of the plurality of sheet material assemblers along the continuous path.

25. A method as set forth in claim 20 wherein said step of performing a binding operation on the first group of sheet material articles in the second section of said one sheet material assembler of the plurality of sheet material assemblers includes connecting a cover with the first group of sheet material articles.

26. A method as set forth in claim 20 wherein said step of performing a binding operation on the first group of sheet material articles in the second section of said one sheet material assembler of the plurality of sheet material assemblers includes applying adhesive to the first group of sheet material articles in the second section of said one sheet material assembler.

27. A method as set forth in claim 20 wherein said step of performing a binding operation on the first group of sheet material articles in the second section of said one sheet material assembler of the plurality of sheet material assemblers includes removing material from the first group of sheet material articles in the second section of said one sheet material assembler.

28. A method as set forth in claim 20 further including clamping the first group of sheet material articles with said second section of said one sheet material assembler of the plurality of sheet material assemblers during at least a portion of the binding operation and while moving the plurality of sheet material assemblers along the continuous path which extends past the plurality of stacks of sheet material articles.

* * * * *